United States Patent [19]

Shibata et al.

[11] Patent Number: 4,897,643

[45] Date of Patent: Jan. 30, 1990

[54] VEHICULAR ELECTRONIC EQUIPMENT WITH DOOR LOCK AND SIDE WINDOW ANTENNA

[75] Inventors: Mineharu Shibata, Ohtake; Tatsuaki Taniguchi, Hiroshima, both of Japan

[73] Assignee: Mazda Motor Corporation, Hiroshima, Japan

[21] Appl. No.: 81,660

[22] Filed: Aug. 4, 1987

[30] Foreign Application Priority Data

Aug. 11, 1986 [JP] Japan ..... 61-186992
Aug. 11, 1986 [JP] Japan ..... 61-186993
Aug. 11, 1986 [JP] Japan ..... 61-186994

[51] Int. Cl.[4] ..... G08C 13/00

[52] U.S. Cl. ..... 340/825.69; 340/825.31; 343/711

[58] Field of Search ..... 340/825.69, 825.72, 340/825.31, 63, 426; 343/711, 712, 713; 307/10.2

[56] References Cited

U.S. PATENT DOCUMENTS 3,599,214 8/1971 Altmayer ..... 343/713
3,703,714 11/1972 Andrews ..... 340/63
4,663,626 5/1987 Smith ..... 340/825.69
4,672,375 6/1987 Mochida et al. ..... 340/825.69
4,719,460 1/1988 Takeuchi et al. ..... 340/825.69
4,727,377 2/1988 Yotsuya et al. ..... 343/713
4,737,784 4/1988 Hirano ..... 340/825.69

FOREIGN PATENT DOCUMENTS 60-159268 8/1985 Japan .
61-197714 12/1986 Japan .

*Primary Examiner*—Donald J. Yusko
*Assistant Examiner*—Edwin C. Holloway, III
*Attorney, Agent, or Firm*—Lynn L. Augspurger

[57] ABSTRACT

According to the invention, vehicular electronic equipment provides an antenna located in the lower portion of the window. Electronic and mechanical accessories of the vehicle are controlled by a control unit which is controlled or actuated in accordance with information received through the antenna. One end of the antenna is formed for an interface contact. The control unit and the antenna are coupled via interface contacts. Preferably the coupling is so controlled that the two contacts thereof are kept open while the window is moving, and in a closed position when the window is stationary. The control unit analyzes whether all doors are locked and the results of such analysis is outputted to the outside of the vehicle through the antenna. This assists in preventing theft.

23 Claims, 12 Drawing Sheets

VEHICULAR ELECTRONIC EQUIPMENT WITH DOOR LOCK AND SIDE WINDOW ANTENNA

BACKGROUND OF THE INVENTION

1. Field of the Invention

This invention relates to vehicular electronic equipment which receives control information from outside the vehicle for controlling electrical/mechanical vehicular accessories, and more particularly, receives the control information via an antenna which is located on the lower portion of the door window.

2. Description of the Prior Art

Based upon recent advances in wireless communications, wireless transmission apparatus have become miniaturized and more economical, leading to the common use of such equipment in vehicular apparatus. Such apparatus are also exhibiting increasing variety. Many of them are operated according to received signals through wireless means from outside the vehicle. For example, there are not only radio and television broadcasting receivers that operate according to signals received from outside the vehicle, there are also keyless entry systems like that disclosed in Japanese Patent Application Laid-Open No. 60-159268, which discloses a control means for door lock/unlock control equipment from the outside of the vehicle by wireless equipment. Also, for receiving various kinds of information for each part, there is a tendency to provide several antennas (FM, AM, TV, keyless entry antennas). For example, as in Japanese Utility Model Application Laid-Open No. 61-197714, there are antennas for radio and television (but not for keyless entry systems) placed on back door windows. In these systems, because of differences in transmitted signal frequencies of information sources, antennas must be of a length to match the frequency waveform of the information source, posing difficulties because of limited space in the vehicle. That is, because there are antennas for radio, television, wireless telephone, and various other wireless transmission systems, various portions of the vehicle, such as the windshield, rear window, etc., are occupied with antennas; it is thus not desirable to attach an additional antenna that extends outside the vehicle for the purpose of a keyless entry system controlling a door lock/unlock operation. For this reason, loop antennas are often attached to the side mirrors for this purpose.

Attaching a keyless entry system antenna to the front or rear window is difficult and also reduces visibility. However, it is also undesirable to locate the antenna at a distance from the control apparatus of the vehicular accessory device.

SUMMARY OF THE INVENTION

An object of the present invention is to provide vehicular electronic equipment of improved utility without reducing visibility for the driver of the vehicle.

Another object of the present invention is to provide vehicular electronic equipment which is useful as a vehicular keyless entry system by installing the antenna on the door window glass (or glass-like material) in the vicinity of the door lock/unlock mechanism.

Yet another object of the present invention is to provide vehicular electronic equipment which does not detract from the efficiency of the antenna.

A further object of the present invention is to provide vehicular electronic equipment which can prevent the door window from being left open, thereby helping prevent the vehicle from being stolen.

According to the present invention, the foregoing objects are attained by providing vehicular electronic equipment comprising receiving means provided in a vehicle body for receiving control information transmitted from outside the vehicle through an antenna located in the vicinity of the lower edge of the door window glass (or glass-like material); and controlling means for controlling vehicular accessory apparatus according to control information received by the receiving means, whereby the antenna that receives the control information does not obstruct visibility.

In another aspect of the invention, the foregoing objects are attained by providing vehicular electronic equipment comprising a portable transceiver for transmitting and receiving information, receiving and transmitting means provided in the vehicle for receiving information from and transmitting information to the outside of the vehicle through an antenna located in the vicinity of the lower edge of the door window glass (or glass-like material); and controlling means for controlling vehicular accessory apparatus according to control information received by the receiving means; whereby the antenna that receives the control information does not obstruct visibility.

The above and other objects, features and advantages of the present invention will become more apparent from the following description when taken in conjunction with the accompanying drawings in which preferred embodiments of the invention are shown by way of illustrative example.

DETAILED DESCRIPTION OF THE INVENTION

Figure 1:
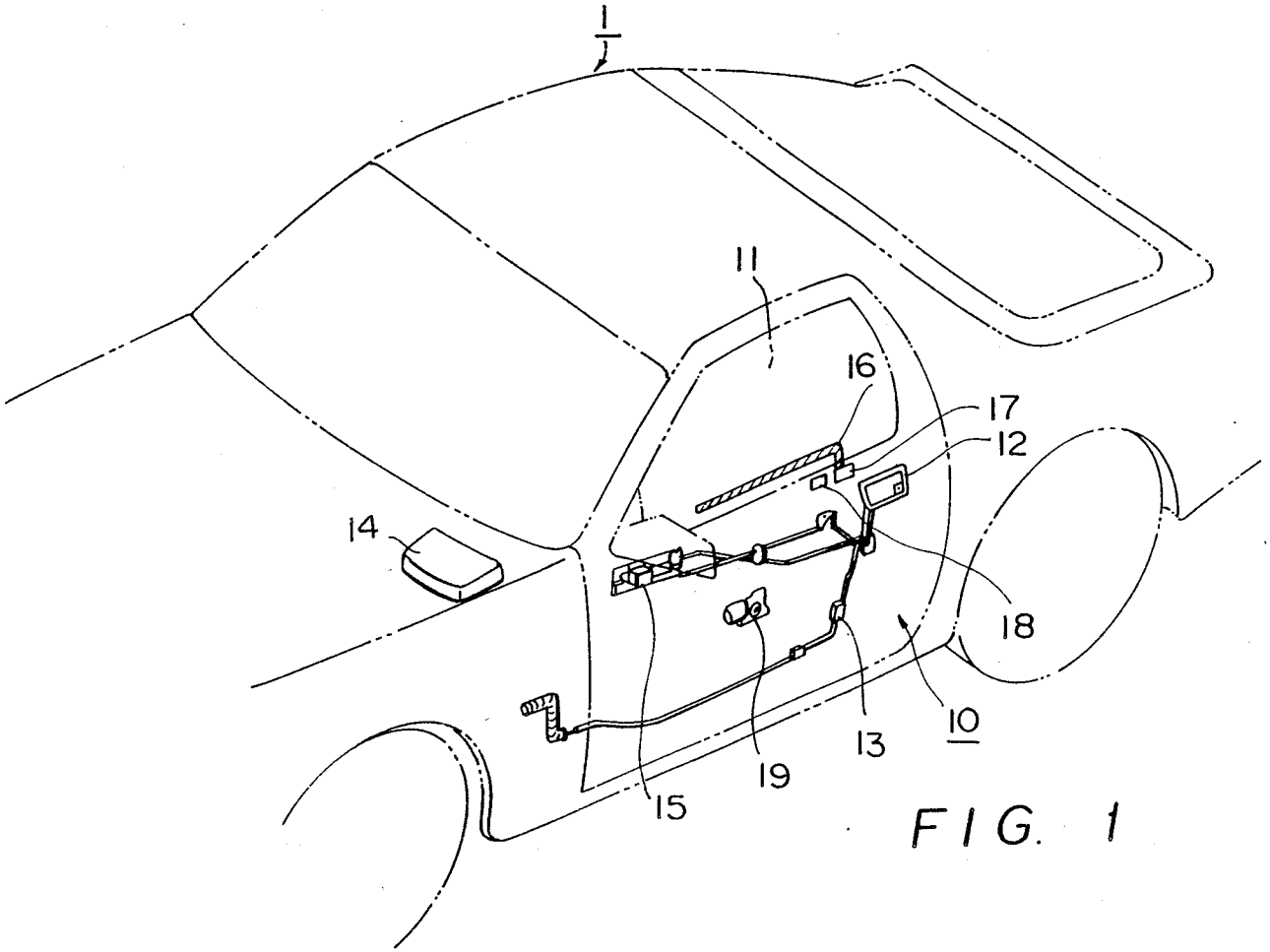
FIG. 1 is a perspective view schematically illustrating the basic construction of vehicular electronic equipment according to the present invention.

Reference will now be had to FIG. 1 showing a perspective view schematically illustrating the basic construction of the vehicular electronic equipment. In the drawing, 1 is a vehicle body; 10 is a side door; 11 is a door window; 12 is a door handle; 13 is a door lock actuator consisting of a miniature motor, damper and electromagnetic clutch; 14 is door lock control equipment; 15 is the door lock portion; 16 is a door lock control antenna which is plated onto the door window; 17 is the antenna lower interface contact for the door lock control; 18 is an antenna connection control part; and 19 is a power window motor.

The door lock control equipment 14 and the door lock control antenna 16 are connected through the interface contact 17 and the antenna connection control part 18. The door lock/unlock operation is controlled in accordance with a door lock control message, which is communicated by wireless means from a portable transmitter, by the door lock actuator 13.

Figure 2:
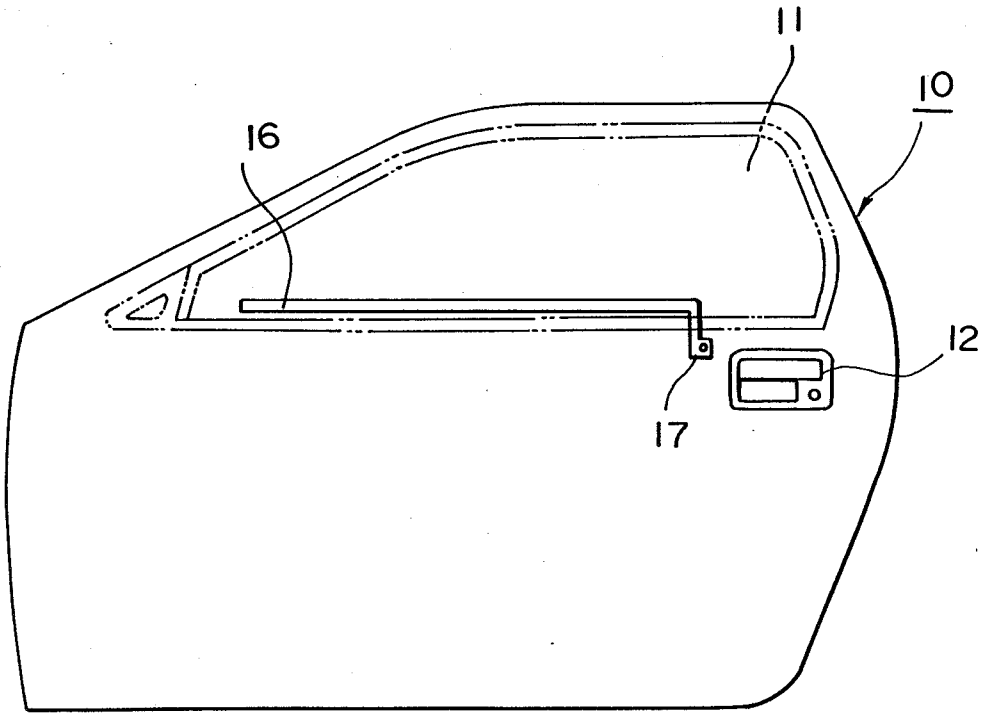
FIG. 2 is a perspective view enlarging an important part of FIG. 1.

As clearly depicted in FIG. 2, door lock control antenna 16 is located approximately parallel to the top of the side panel of the door in the vicinity of the lower edge of the door window glass (hereinafter, the term "glass" includes glass or glass-like material) as shown in FIG. 2. This is done to increase the driver's visibility compared to a system where the antenna is located on the central part, upper portion, or both lateral portions of the door window 11. By locating the antenna on the lower part of the door window 11 near the top of the door panel, it is placed outside the field of view of the driver. By so doing, when the door window 11 is lowered, the antenna is hidden inside the door panel and cannot receive any control electromagnetic waves from the outside. However, there is no practical problem as the door lock/unlock wireless control is not usually used when the door window is lowered, and it is possible to reach in and lock the door from the outside. Also, plating the antenna on the glass (or glass-like material) of the door window 11 is simple in structure compared to a structure in which an antenna is separately provided.

Door window 11 is usually subject to frequent opening and closing. For this reason, physically connecting the door lock control antenna 16 and the door lock control equipment 14 constitutes a problem in terms of the strength of the signal wires connecting them, affecting the reliability of the system. For this reason, it is desirable to establish a structure connecting these parts through a fixed electrical contact point only when it is necessary. But if the contact points are always set to make physical contact, the interface contact wears away through constant contact and reliability falls drastically. For this reason, in this embodiment, when the door window 11 is in the process of opening or closing, the interface contact is separated, and when the door window 11 is stationary, the interface contacts are brought into a closed position.

The interface contact control structure for this embodiment is shown in FIGS. 3(A) and (B).

That is, this embodiment adopts a power window mechanism whereby the interface contacts are in an open condition when the power window motor 19 is driving the door window 11 in an upward or downward direction.

FIG. 3(A) shows the door window glass face viewed from the inside door panel in order to discuss the structure of the connecting parts between the interface contact 17 of the door lock control antenna 16 and the receiver signal line 27 (shown in FIG. B) connected to the door lock control equipment 14. 21 is a push-pull solenoid which separates the control equipment interface contact 22 and the antenna interface contact 17. 22 is an interface contact bar. 24 is an interface contact pivot bracket which is provided on the door panel side. 25 is a spring for putting constant pressure on the control equipment interface contact 23 and pushing it against the antenna interface contact 17 by means of spring force.

Figure 3:
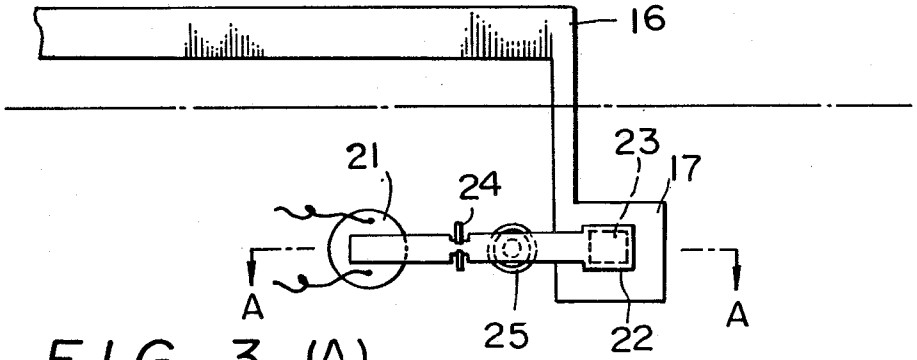
FIGS. 3(A) and (B) are explanatory views illustrating an interface connection structure between the antenna portion and the control equipment of an embodiment of this invention.
Figure 3:
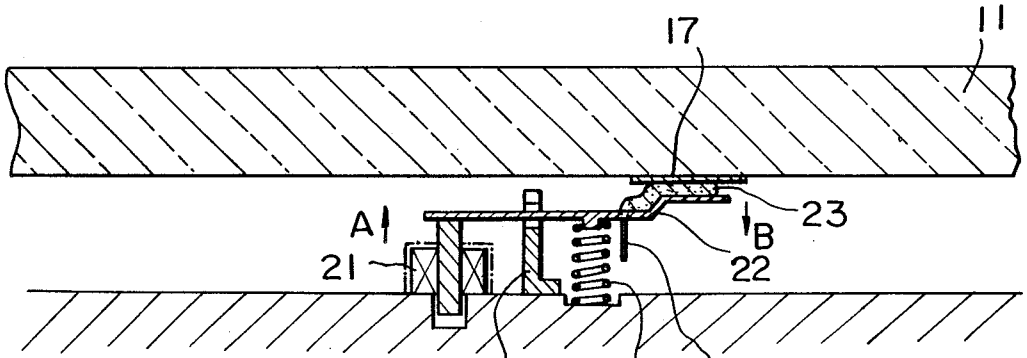

Reference will be had to FIG. 3 (B) which is a sectional view taken along the line A—A in FIG. 3. In FIG. 3(B), if the push-pull solenoid 21 is activated in the direction of the arrow in the figure, contact bar 22 is levered with pivot bracket 24 as the focal point, the spring force of spring 25 is overcome and solenoid 21 is actuated causing the contact to move in the direction of arrow B in the figure. Based on this action, the contact moves to the open condition. When push-pull solenoid 21 is not activated, both contacts remain closed and in a condition of contact due to the spring force of spring 25. Also, as shown in the figure, the width (in the up-down direction) of the antenna interface contact 17 is very narrow. Therefore, when the window is lowered even a little, the interface contacts fail to make contact. But, as discussed above, when the door window 11 is lowered, usually the use of the lock/unlock wireless control is not required as it is possible to unlock the door by reaching in from the outside; thus there is no practical problem. Also when the window is not completely closed, the door cannot be locked using the portable transceiver as described later. By providing for a warning to be given for this condition, it is possible to inform the driver that he has forgotten to close the window.

Figure 4:
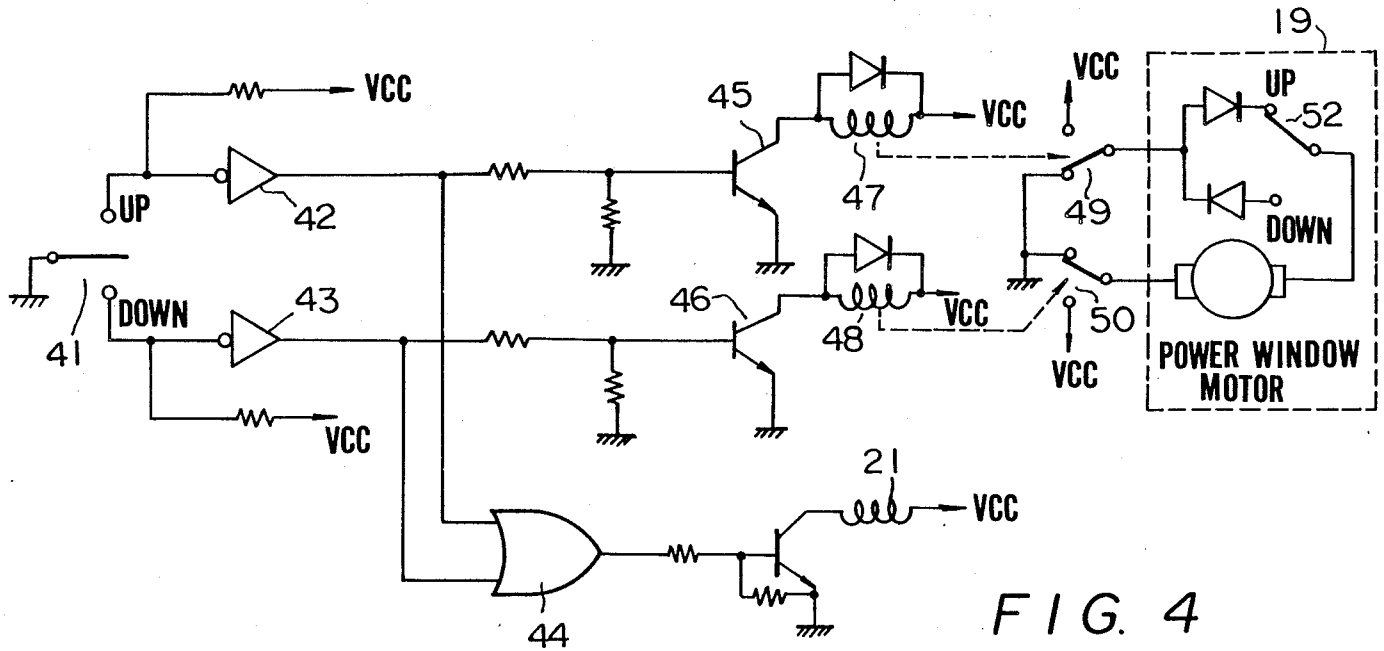
FIG. 4 is a circuit diagram of the interface shown in FIGS. 3(A) and (B)

FIG. 4 shows an electrical circuit diagram of the interface contact control part depicted in FIG. 3 A and FIG. 3B. In FIG. 4, 41 is a power window switch. If the power window switch 41 is moved to the "UP" position, the input level of driver 42 switches from "high" level to "low" level, and the output level of driver circuit 42 switches from "low" level to "high" level. Based on this, transistor 45 is turned on. Current thus flows between the collector and emitter, and the power window up solenoid 47 is energized. Based on this action, contact 49 is connected to the drive electric source Vcc side, switch 52 inside the power window motor 19 is connected to the "UP" side, the power window motor 19 rotates, and the window is moved in the up direction. At this time, the output of the driver 42 is inputted into one leg of the OR gate 44 and energizes push-pull solenoid 21. As explained above, the antenna interface contact 17 and the control equipment contact 23 are separated when the window moves up or down.

When the power window switch 41 is returned to the "NEUTRAL" position, the push-pull solenoid 21 condition is removed, and the control equipment interface contact 23 makes contact with the antenna interface contact 17.

When the power window switch 41 is activated to the "DOWN" position, the input level of driver 43 changes to "low" level, the output level of driver 43 changes to "high" level, transistor 46 is turned on, and power window down solenoid 48 is activated. Due to this action, contact 50 is connected to drive voltage Vcc at the same time, the switch 52 inside the power window 19 is connected to the "DOWN" side, power window motor 19 is rotated in the window "DOWN" direction, and the window is moved in the down direction. At this time, the output of drive 43 is also inputted to the other side of OR gate 44, energizing push-pull solenoid 21. Because of this, the antenna contact 17 and the control equipment contact 23 are separated.

In this manner, in this embodiment, when the power window switch is operated and the window is lowered or raised, the interface contacts are separated.

Figure 5:
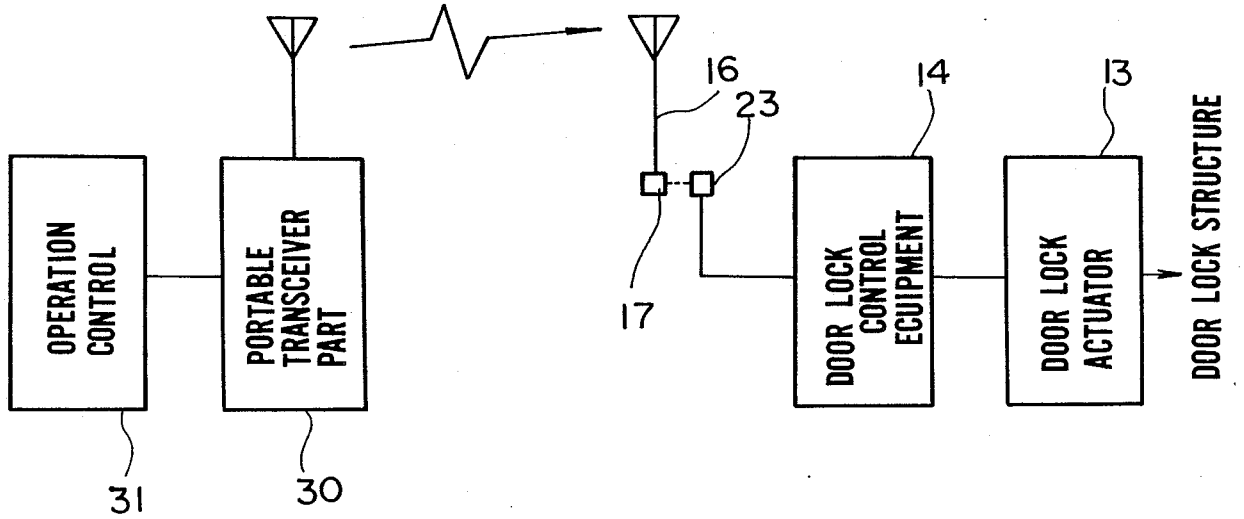
FIG. 5 is a general block diagram of the embodiment of a door lock control system.

FIG. 5 shows the control system block diagram of a door lock/unlock control with an antenna part structure control system as explained above.

In FIG. 5, the reference numeral 30 is a portable transmitter part, and 31 is an operating control section which provides an operator interface to the portable transmitter part 30. If an input is made to the operator switch (not shown in figure) of operation part 31 of the portable transmitter 30 while the operator is outside the vehicle, a frequency signal equivalent to a particular system is generated. This signal is received by the previously described door lock control antenna 16 which is located on the side of window 11, the received signal is sent to the door lock control equipment 14 through interface contacts 17 and 23, and is analyzed here. Door lock control equipment 14 activates the door lock actuator 13 and locks the door using conventional techniques if the received signal is a door lock command. If it is a door unlock command, it will disengage the lock by activation of the lock control actuator 13.

Also, although the explanation hereinabove has used a power window as the example, it is applicable even if the window is manually operated. When the window handle is turned, it separates the antenna contact 17 and the control equipment contact 23. When the window handle is stationary, the interface contacts are in a state of physical contact with the window. When the window is stationary, the contacts are thus directly in contact with the window, and when the window is being lowered or raised, the interface contacts are separated.

However, this invention is not limited to this concept only. Since the signal received from the door lock control antenna 16 is of high frequency, it can be transferred through a frequency coupling method.

Figure 6:
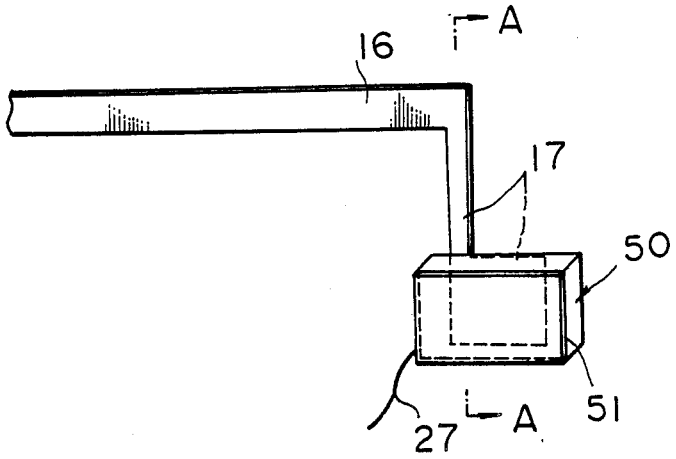
FIGS. 6(A) and (B) are explanatory views illustrating an interface of another embodiment of this invention where capacitive coupling is used between the antenna portion and the control portion.
Figure 6:
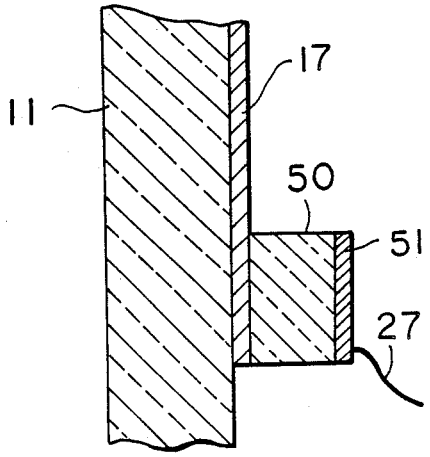

FIGS. 6(A) and (B) show an example where the interface contacts are made through a capacitive coupling method.

FIG. 6(A) shows the front view; FIG. 6(B) shows a section. The interface contact 17 of the door lock control antenna 16 is attached to a glass spacer 50. The opposite surface of the spacer to that attached to interface contact 17 comes into contact with the interface contact 51 provided for the control equipment, and the interface contact 51 is connected to door lock control equipment 14 through signal wire 27. In this arrangement, an appropriate glass spacer is thus provided between the interface contacts, which is capable of providing very good capacitive coupling.

Since the glass surface of the glass spacer is smooth, it can move while in contact and also reduce wear due to friction. The space between contacts can also be easily maintained. Based on FIG. 6, the glass spacer 50 is only the width of the portion of the antenna contact 17 that projects to the side (i.e. it does not overlap the vertical portion of the antenna connecting the antenna to the antenna interface contact). It may thus be structured in such a manner that the glass surface of the glass spacer 50 does not touch the antenna while the window is moved up or down. By this arrangement, it is possible to reduce wear on the antenna part even further.

In the discussion above, a door lock antenna was described, but this antenna is not limited to this application. It is able to be used for an FM antenna, AM radio antenna, and any other type of antenna.

Figure 7:
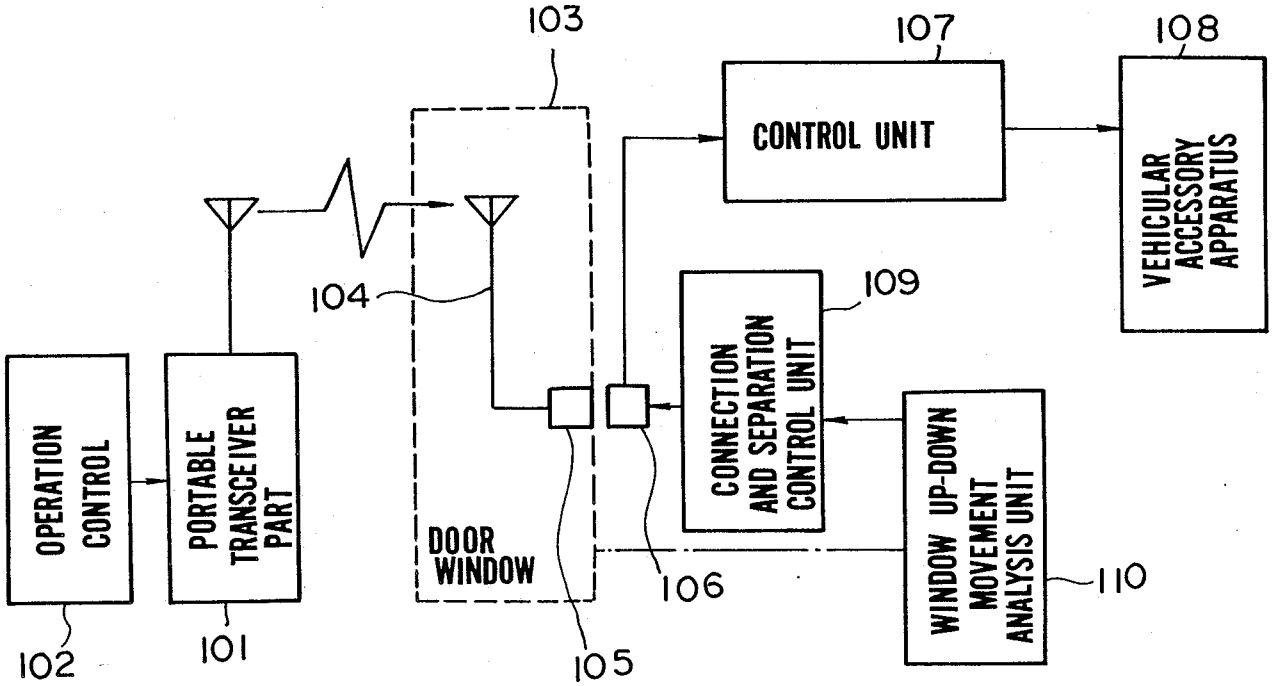
FIG. 7 is a functional block diagram of the embodiment shown in FIGS. 6(A) and 6(B)

In FIG. 7, if an input is made to the control switch (not shown in the figure) on the operator control 102 of the portable transceiver part 101, a corresponding control signal is usually emitted. This signal is received by the antenna 104 which is located on the door window 103. Connection and separation control means 109 controls the first contact part 105 and the second contact part 106 in making connection electrically. This received signal is sent to the control unit 107 through the first contact point part 105 which is installed on one end of the antenna 104, and the second contact part 106, and is analyzed here. The vehicle accessory apparatus 108 (for example, keyless entry) is controlled in accordance with the received signal.

Here, if the window up-down movement analysis unit 110 detects an up or down movement of the window 103, the connection and separation control unit 109 separates the second contact part 106 from e first contact part 105.

As indicated in the example above, in this embodiment, it is possible to provide a keyless entry apparatus control antenna outside the field of vision of the driver, and thus improved visibility.

Although the above explanation describes the use of a door window antenna for a keyless entry system for lock/unlock door operation, this invention is not limited to this application.

For example, when leaving the vehicle after parking it, it is normal to lock all the doors to prevent burglary. But even if the doors are locked perfectly, the door may be unlocked by merely putting one's hand through the window if the window is fully or partially open. By providing the antenna part in the lower section of the door window, the vehicular accessory apparatus is unable to transmit signals to or receive signals from the portable transceiver if the window is fully or partially open. It is possible to use this to detect the open state of the door window. If an alerting means is provided, this can be used to give a definite indication that the door windows are not closed.

Figure 8:
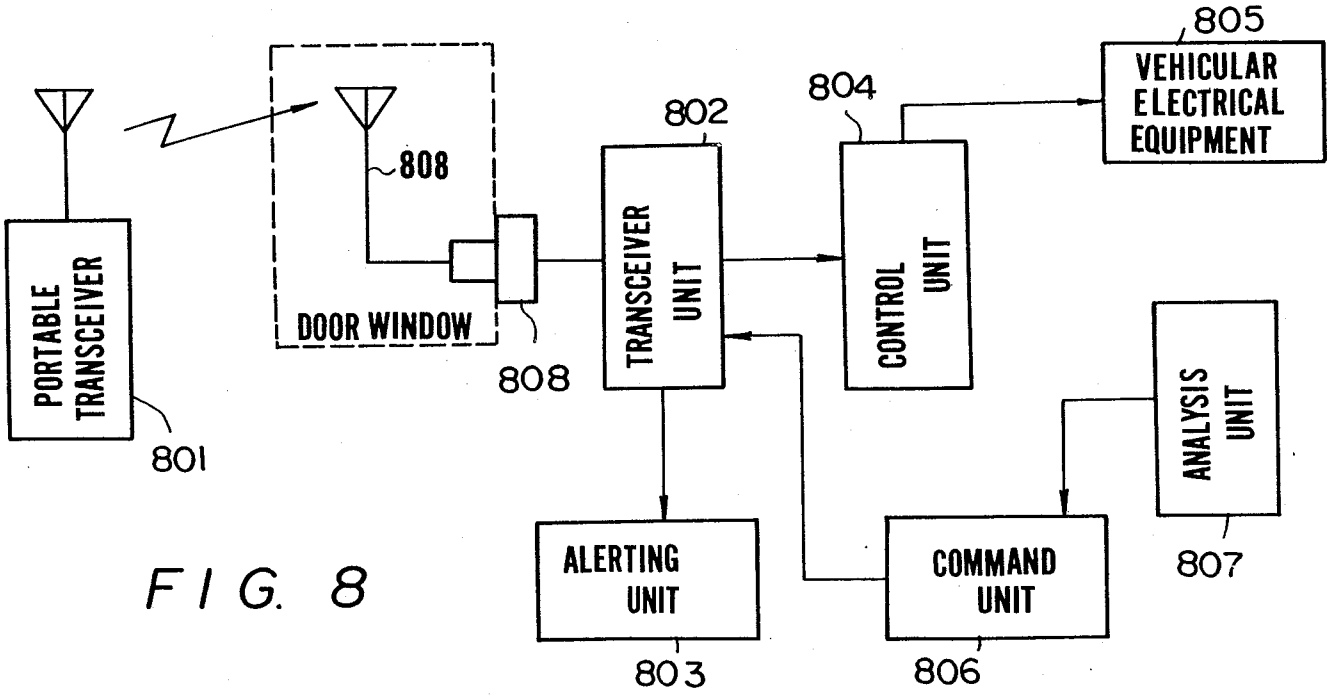
FIG. 8 is functional block diagram of another embodiment.

FIG. 8 shows another functional block diagram of this embodiment.

As shown in the drawing, another embodiment of this invention comprises a portable transceiver 801 which can communicate predetermined fixed information; an antenna unit 808 which is installed on the door window of the vehicle to provide communication with the portable transceiver 801; a transceiver 802 installed in the vehicle to transmit information between the transceiver 801 through the antenna unit 808; a control unit 804 which controls vehicular electrical equipment in response to commands from this transceiver; an analysis unit 807 which analyzes all the door locks of the vehicle; a command unit 806 which commands the communications between the portable transceiver 801 and the transceiver in accordance with the analysis of this analysis unit 807; and an alerting unit 803 which informs the user that the communication is impossible.

Figure 9:
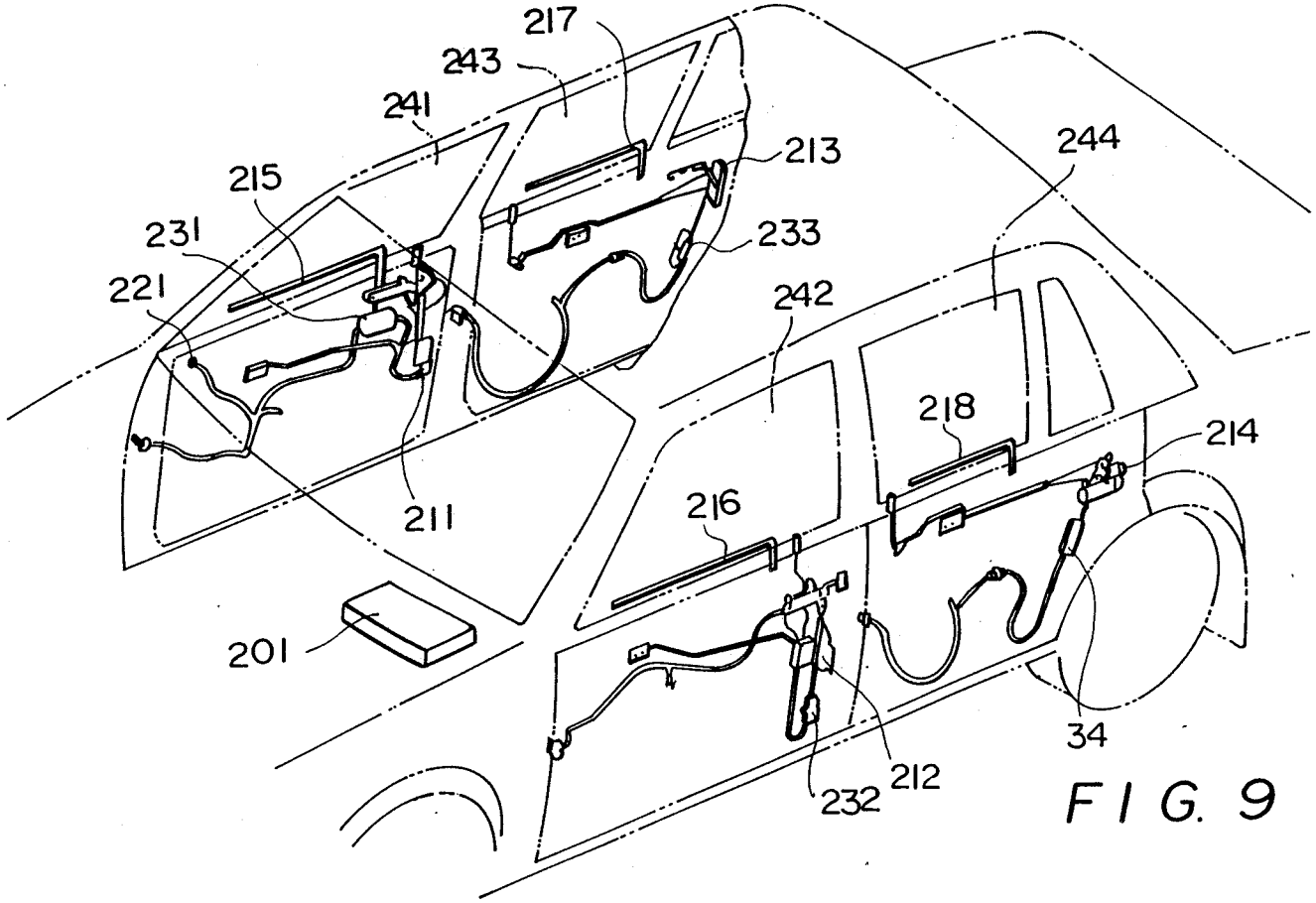
FIG. 9 is a perspective view illustrating the positional relationship of elements arranged in accordance with FIG. 8.
Figure 10:
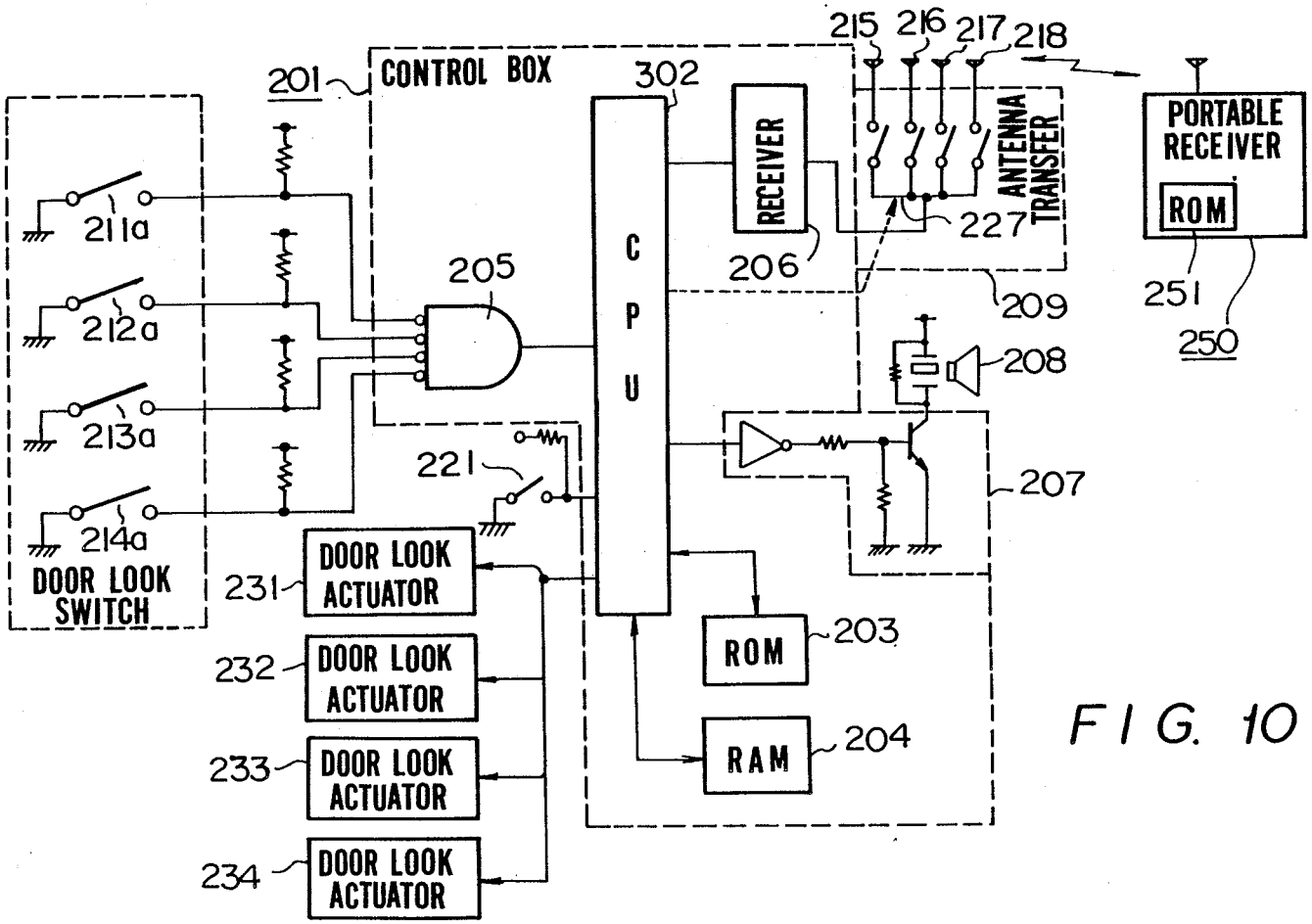
FIG. 10 is a control circuit diagram of the embodiment shown in FIG. 9.

FIG. 9 shows a perspective view of the positional relationship of each element arranged in accordance with FIG. 8. In the drawing, 201 is the housing that contains the control box which contains the electrical parts as shown in FIG. 10; 211 is the front right door lock switch structure; 212 is the front left door lock switch structure; 213 is the back right door lock switch structure; and 214 is the back left door lock switch structure. 215 is the front right antenna; 216 is the front left antenna; 217 is the back right antenna; and 218 is the back left antenna. Each antenna is located near the bottom of its respective door window (241 through 244) in parallel with the top edge of the door panel (door window sill). The driver's view outside the vehicle is thus not obstructed.

Also, 221 is the control box lever switch which is provided for the front right door; 231 is the front right door lock actuator; 232 is the front left door lock actuator; 233 is the back right door lock actuator; and 234 is the back left door lock actuator.

FIG. 10 shows the detailed circuitry of the control box 201. Where the function of the parts are the same as in FIG. 9, the same numbers are used and explanations of such parts are omitted.

Figures 11, 12:
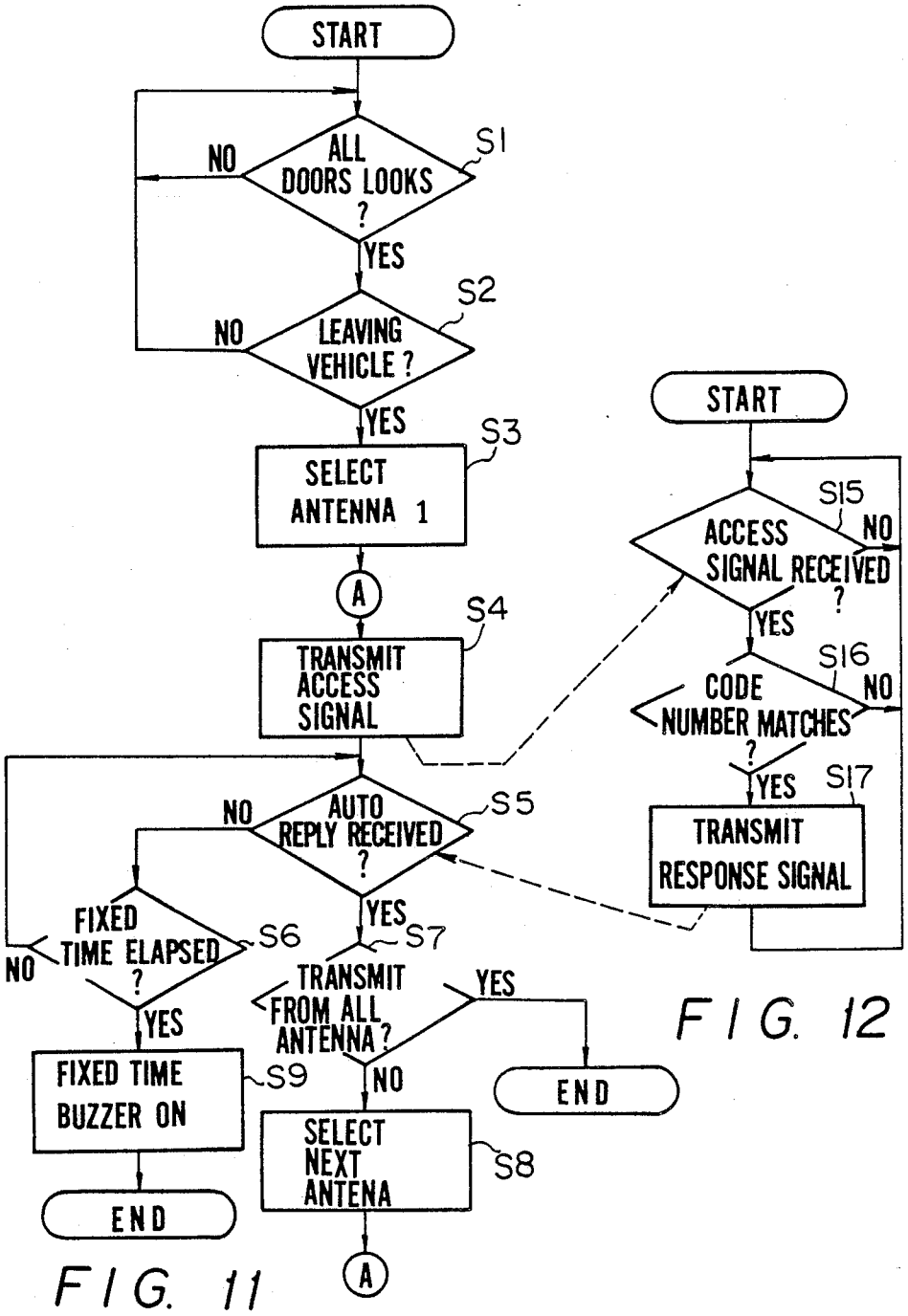
FIGS. 11 through 14 are flow charts indicating CPU operation and control in accordance with the embodiment of FIG. 10.

CPU 202 is provided in the control box 201. CPU 202 performs processing according to the program which is shown in FIGS. 11 and 12, to be described later, to control the entire set of equipment including the lock-/unlock of each side door; 203 is a ROM which contains the program and the code number which will be explained later; 204 is a RAM which stores temporary process data; and 205 is a NAND gate which takes its inputs from switch contact points 211*a* through 214*a* of each door lock switch 211 through 214. NAND gate 205 has inputs from all door locks. When all the door lock switches are closed and contacts are made, the gate activates. 206 is a transceiver which transceives predefined data to and from the portable transceiver 250 under the control of CPU 202. 207 is a drive circuit for the buzzer 208. 209 is an antenna transfer to control whether or not the antennas 215 through 218 are connected to the transceiver 206 under the control of CPU 202. The detailed arrangement of antenna transfer has been discussed in conjunction with FIGS. 3 (A) and (B).

Figure 14:
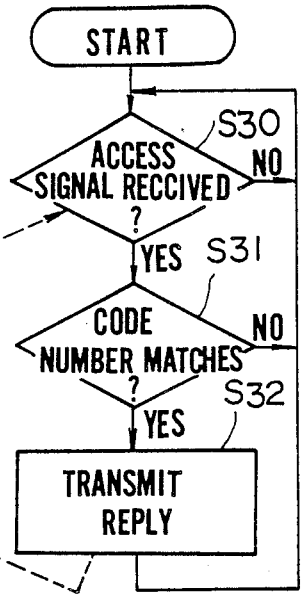

250 is a portable transceiver which the driver carries with him when leaving the vehicle. The transceiver 250 is used for the purpose of door lock control, to be described later, as well as to detect whether a window or windows are open, and for door unlock control. Portable transceiver 250 transmits and receives control information to and from transceiver 206 according to the program which is shown in FIGS. 12 and 14 and stored in ROM 251. In this embodiment each door window is provided with an antenna as shown in FIG. 9 (items 215 through 218), a total of four antennas. The antennas are selected and sequentially connected under the control of CPU 202 to transceiver 206 via signal wire 227.

The explanation concerning the embodiment described above for door lock/unlock control and the control associated with preventing the driver from leaving the vehicle with the windows down will be made while referring to the flow charts shown in FIGS. 11 through 14.

FIGS. 11 and 12 are flow charts for warning the driver in the case where the windows are lowered. FIG. 11 shows the control in the vehicle and FIG. 12 shows the control in the portable transceiver 250. CPU 202 in the vehicle monitors the door lock switches 211*a*–214*a* in Step S1. It waits until all the switches are closed, that is, all doors are locked. After all the doors are locked, the program proceeds to Step S2. At this time it determines whether or not the driver has left the vehicle.

The CPU 302 can detect when an inner knob (211*a*–214*a*) has been pushed (switch contact closed) with the door in an open position and the door subsequently closed while the outer door handle is held in an open position. It can also detect when all four doors are locked while the doors are in an open position and the doors are subsequently closed. It can also detect when all doors and closed and then locked using the key. There are, depending upon the type of vehicle, different analysis requirements, but further detailed explanation has been omitted.

In this manner, when it is determined that all the doors are locked in Step S2, the program proceeds to Step S3, in which antenna transfer 209 is used to select and connect only one antenna to the control: for example, antenna 1 (front right antenna 215). The program then continues to Step S4. In Step S4, the access signal is transmitted which includes a particular code number associated with the equipment and which is already stored in ROM 203 or in RAM 204. The signal is transmitted through transceiver 206 and antenna 1.

Portable transceiver 250 is in the monitoring state for the arrival of the access signal from transceiver 206 as shown in Step S15. When the access signal transmitted by Step S4 of FIG. 11 is received, it proceeds to Step S16 from Step S15. The code number in the access signal is checked to determine if it agrees with the code number stored in its own memory ROM 251. At this point, if the code number is different, the received access signal is invalid and the program returns to Step S15.

If the code number is in agreement, a response signal in which its own code number is incorporated is generated and transmitted by the portable transceiver 250 in Step S17 and the program is returned to Step S15 again.

Because this response signal is retransmitted to transceiver 206 after it has transmitted the access signal by Step S4, a check is made to determine whether or not the response signal has been received from the portable transceiver 250 in the next program Step S5. In this step, if the response signal is not received, Step S6 determines whether a fixed time has elapsed. If a fixed time has not elapsed, the program returns to S5 again.

On the other hand, if a response signal is received from the portable transceiver 250, the program proceeds to Step S7 from Step S5, connecting each antenna sequentially and checking whether or not it has finished transmitting the access signal from antenna and received the corresponding response signals. If it is not finished with all the antennas at Step S8, it selects and connects only the next antenna (front left antenna 216, back right antenna 217, and back left antenna 218, in that order), the program returns to Step S4, and executes the transceiving process for the next antenna.

In Step S7, if the entire transceiving process for all antennas is completed successfully, the process is complete.

On the other hand, if a response signal is not received from the portable transceiver 250 within a fixed time duration, the program proceeds to Step S9 from Step S6, activates the buzzer drive circuit 207 and outputs a warning sound for a fixed length of time from buzzer 208 to inform the person leaving the vehicle that communication is not possible, whereupon the process is ended.

At this point, because the antennas are located near the bottom of the door window, when the windows are down the antennas are hidden behind the door panels and the respective interface contacts are not connected to each other, making it impossible to communicate. For this reason, by using the buzzer to inform the user of the window-open condition, the driver can be alerted that he is leaving the vehicle in this condition. This is a very desirable means to prevent the vehicle from being stolen.

If the portable transceiver 250 is accidentally left in the vehicle or if the portable transceiver 250 is stored in an electromagnetic shielded area, it will generate a warning signal in the same manner. It can thus be used to prevent the driver from leaving and/or forgetting the portable transceiver 250.

This output warning sound is not limited to a buzzer; an audio output signal which uses a stereo system installed in the vehicle or a vehicle radio or the vehicle horn may be used to output an audio signal.

Figure 13:
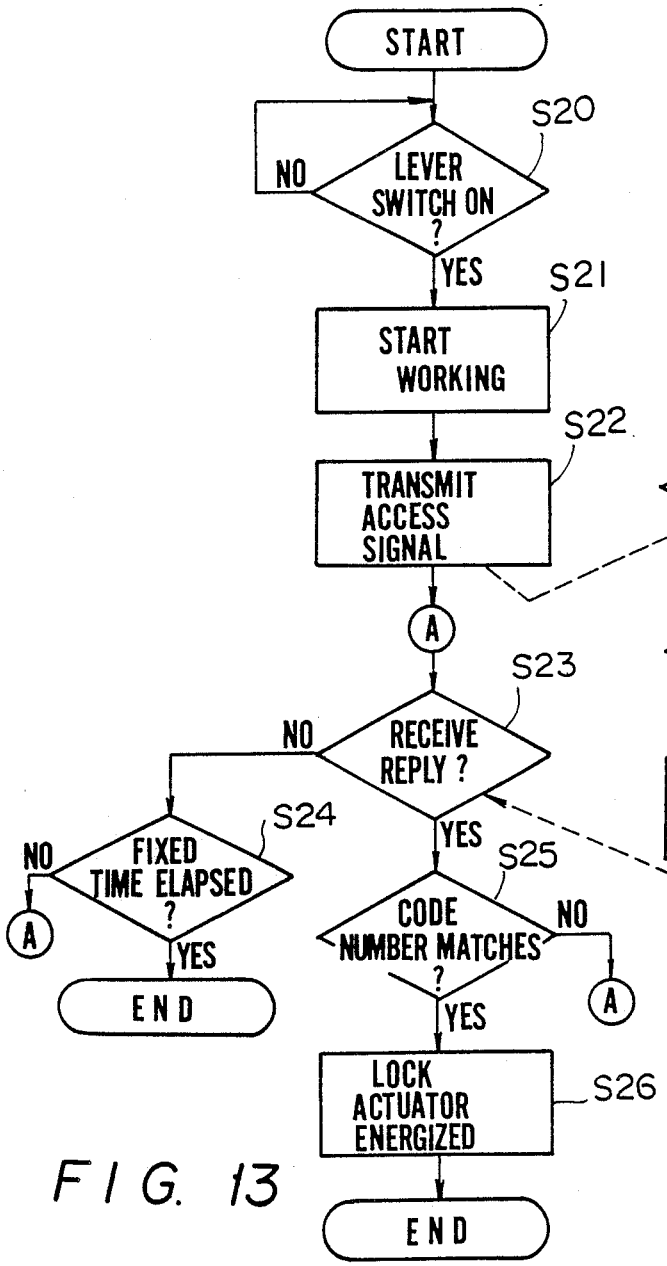

The lock/unlock control of this embodiment is described hereafter using FIGS. 13 and 14.

Usually, the power source is not supplied to the control box 201. It must be supplied before the process starts. For activating the control box 201 from the outside (for requesting transmission from the control box 201), the activating switch 221 which is located inside the front right door panel 204 as shown in FIG. 13, is pushed down in Step S20. If this actuating lever switch is pushed down, the power source of the equipment is turned on as indicated in Step S21, and the system starts working. First, in Step S22, it sends out from each antenna 215 through 218 an access signal which includes its own code number for its own equipment stored either in ROM 203 or RAM 204 through the transceiver 206. Then in Step S23 and Step S24, it waits for a reply to be transmitted from the portable transceiver 250 for a fixed length of time.

In the portable transceiver 250, there is a continuous monitoring process to determine if the access signal is received or not in Step S30. If the access signal is received, it checks the code number included in the access signal, and checks for agreement with the code number which is registered in ROM 251. That is, it checks to determine whether or not the access signal matches its own equipment or not.

. If it does not match, the program returns to Step S30 again for preparation to receive another access signal. If the code number matches, it proceeds to Step S32, generates a reply message which includes its own equipment code number which is stored in ROM 251 and sends this message. When it is desired to request a cancellation of the door lock command, the door lock command-cancel button, not shown in the figure, located on the portable transceiver 250 is activated, resulting in the generation of the door lock cancel command in the reply message that is sent.

This reply message is received by the transceiver 206, resulting in the CPU 202 control moving from Step S23 to Step S25. It checks the code number in the reply message, and checks the code number in the data to determine if the message is directed to its own equipment. If the reply message includes a code number which is registered in ROM 203 or RAM 204, the program proceeds to Step S26, and executes the process commanded by the message. For example, when it is a door lock cancel command, it will deactivate door lock actuators 231 through 234 and cancel the door lock operation and terminate processing.

On the other hand, if the code number is not registered, the program returns to Step S23 again because it is not a reply message directed to its own equipment.

Also when there is no reply message within a fixed period of time, processing is terminated.

According to this embodiment, as described above, the driver can be alerted that he is leaving the vehicle with the window open. It is thus capable of being used for crime prevention purposes.

As explained above, according to this invention, an easily usable antenna, installed without reducing visibility, especially in vehicles with keyless entry, and which does not impair the antenna's functioning in receiving signals, is provided by locating the antenna in the proximity of the door lock/unlock structure.

Even with repeated door window movement up and down, the connection is still maintained in good condition as compared to other systems where such movement causes some damage and reduces the reliability of the connection between the antenna and control equipment.

In addition, it can help prevent the driver from leaving the vehicle with the window down, thus helping prevent the vehicle being stolen.

As many apparently widely different embodiments of the present invention can be made without departing from the spirit and scope thereof, it is to be understood that the invention is not limited to the specific embodiments thereof except as defined in the appended claims.

What is claimed is:

1. Remote wireless controlled vehicular electronic system, comprising:

receiving means provided in a vehicle body for receiving control information transmitted from outside the vehicle through an antenna located in the vicinity of the lower edge of the door window glass; and controlling means for controlling vehicular accessory apparatus according to control information received by the receiving means; and wherein the said antenna is located approximately parallel to the sill of the door window and one end thereof is formed for an interface contact;

said controlling means including switching means and being coupled to provide a control signal to actuator means to open and close a switch between the antenna interface contact and an interface contact provided on said controlling means according to whether the window glass is moving or not moving; and said antenna that received the control information being configured and positioned to limit any obstruction of visibility.

2. Remote wireless controlled vehicular electronic system according to claim 1 where the window includes a power window mechanism and the switching means is so controlled that the two contacts are kept in an open position while the window is moving, and in a closed position while the window is stationary.

3. Remote wireless controlled vehicular electronic system according to claim 1 wherein said switch is a capacitive coupling means which connects capacitively the interface contact of the antenna and the interface contact provided on the control means.

4. Remote wireless controlled vehicular electronic system according to claim 1 wherein the antenna is located in respective windows of a vehicle.

5. Remote wireless controlled vehicular electronic system according to claim 1, wherein the controlling means controls locking means to lock and unlock doors.

6. Remote wireless controlled vehicular electronic system, comprising:

a portable transceiver for transmitting and receiving information, receiving and transmitting means provided in a vehicle body for receiving information and transmitting information to the outside of the vehicle through an antenna located in the vicinity of the lower edge of the door window glass; and controlling means for controlling vehicular accessory apparatus according to control information received by the receiving means; and wherein the said antenna is located approximately parallel to the sill of the door window and one end thereof is formed for an antenna interface contact;

said controlling means including switching means and being coupled to provide a control signal to actuator means to open and close a switch between said antenna interface contact and an interface contact provided on said controlling means according to whether the window glass is moving or not moving; and said antenna that received the control information being configured and positioned to limit any obstruction of visibility.

7. Remote wireless controlled vehicular electronic system according to claim 6 where the window includes a power window mechanism and the switching means is so controlled that the two contacts are kept in an open position while the window is moving, and in a closed position while the window is stationary.

8. Remote wireless controlled vehicular electronic system according to claim 6 wherein said switch is a capacitive coupling means which connects capacitively the interface contact of the antenna and the interface contact provided on the control means.

9. Remote wireless controlled vehicular electronic system according to claim 6 wherein the antenna is located in respective windows of a vehicle.

10. Remote wireless controlled vehicular electronic system according to claim 6, wherein the controlling means includes:

means for analyzing whether all doors are locked;

receiving and transmitting means to communicate to the portable transceiver the results of such analysis; and an alerting means to inform of the fact that such communication is not possible.

11. Remote wireless controlled vehicular electronic system according to claim 10, wherein the antenna is located in each window and each door lock is checked in turn.

12. Remote wireless controlled vehicular electronic system according to claim 10, wherein the controlling means includes alerting means to inform of the fact that communication is impossible by outputting an audio signal.

13. Remote wireless vehicular electronic system for door lock/unlock using a side window antenna, comprising:

a receiving means provided in a vehicle side window for receiving control information transmitted from outside the said vehicle through an antenna located at the lower edge of said side window, said receiving means being disposed primarily parallel to an associated window lower sill;

a controlling means for controlling vehicular accessory apparatus according to control information received by the receiving means; and a switching means to open and close the contacts between the receiving means and controlling means according to whether the said window glass is moving or not moving.

14. Remote wireless vehicle electronic system for door lock/unlock using a side window antenna according to claim 13, where the window includes a power window mechanism and where the switching means is so controlled such that the two contacts are kept in an open position while the window is moving and in a closed position while the window is in fully closed position.

15. Remote wireless vehicle electronic system for door lock/unlock using a side window antenna according to claim 13 wherein the switching means is a capacitive coupling means which connects capacitively the interface contact of the antenna and the interface provided on the control means.

16. Remote wireless vehicle electronic system for door lock/unlock using a side window antenna according to claim 13, wherein the antenna is located at the lower portion of the window in such a manner that is becomes ineffective when the window is in the lowered state.

17. Remote wireless vehicle electronic system for door lock/unlock using a side window antenna according to claim 16, wherein the antenna is "L" shaped with a primary parallel received disposed parallel to the window sill.

18. Remote wireless vehicle electronic system for door lock/unlock using a side window antenna according to claim 13 wherein a means for controlling door lock and unlock means is provided.

19. Remote wireless vehicular electronic system for door lock/unlock means, comprising:

a portable transceiver for transmitting and receiving information;

receiving and transmitting means provided in the vehicle for receiving information from and transmitting information to the portable transceiver through an antenna;

an antenna located essentially parallel to the lower edge of a side window of said vehicle;

and a controlling means for controlling vehicular accessory apparatus according to the control information received by the receiving means, wherein the control means includes a switching means to open and close an interface contact switch, according to whether the window glass is moving or not moving, between an antenna interface contact and an interface contact provided on the control means.

20. Remote wireless vehicle electronics for door lock/unlock using a side window antenna according to claim 19, wherein the window includes a power window mechanism and the switching means is so controlled that the two contacts are kept in an open position while the window is moving, and in a closed position when the window is stationary and in the closed position.

21. Remote wireless vehicle electronic system for door lock/unlock using a side window antenna according to claim 19, wherein the switching means is a capacitive coupling means which connects capacitively the said interface contact of the antenna and the said interface contact provided on the control means.

22. Remote wireless vehicle electronic system for door lock/unlock using a side window antenna according to claim 19, wherein the antenna may be located in any side window and may be located in all side windows.

23. Vehicular electronic equipment according to claim 22, wherein the antenna is shaped like an "L".

* * * * *